United States Patent [19]

Zafiroglu

[11] Patent Number: 4,773,238

[45] Date of Patent: Sep. 27, 1988

[54] STITCHED NONWOVEN DUST-CLOTH

[75] Inventor: Dimitri P. Zafiroglu, Wilmington, Del.

[73] Assignee: E. I. Du Pont de Nemours and Company, Wilmington, Del.

[21] Appl. No.: 85,167

[22] Filed: Aug. 14, 1987

[51] Int. Cl.[4] ..... D04B 23/08

[52] U.S. Cl. ..... 66/192; 66/196; 66/202

[58] Field of Search ..... 66/190, 192, 196, 202, 66/85 A, 84 A; 28/156

[56] References Cited

U.S. PATENT DOCUMENTS

| | | | |
|---|---|---|---|
| 2,219,240 | 10/1940 | Siegel | 66/190 |
| 3,649,428 | 3/1972 | Hughes | 161/50 |
| 3,769,815 | 11/1973 | Ploch et al. | 66/85 A |
| 4,606,964 | 8/1986 | Wideman | 428/152 |
| 4,657,802 | 4/1987 | Morman | 428/152 |

FOREIGN PATENT DOCUMENTS

| | | | |
|---|---|---|---|
| 917890 | 1/1973 | Canada | 28/156 |
| 48-20908 | 6/1973 | Japan | 66/84 A |

OTHER PUBLICATIONS

K. W. Bahlo, "New Fabrics Without Weaving" Papers of the American Association for Textile Technology, Inc., pp. 51–54 (Nov. 1965).

Product Licensing Index, Research Disclosure, "Stitch-bonded Products of Continuous Filament Nonwoven Webs", p. 30 (Jun. 1968).

*Primary Examiner*—Ronald Feldbaum

[57] ABSTRACT

A nonwoven fabric comprises a layer of substantially nonbonded layer of textile-decitex fibers. The layer is multi-needle stitched with an elastic stitching thread which causes the fabric to contract to less than 40%, preferably to 30 to 20%, of its original area. The nonwoven fabric is particularly suited for use as a dust-cloth.

16 Claims, No Drawings

STITCHED NONWOVEN DUST-CLOTH

BACKGROUND OF THE INVENTION

1. Field of the Invention

This invention concerns a layer of substantially nonbonded fibers which is multi-needle stitched with elastic thread to form a nonwoven fabric. The fabric is particularly useful as a dust-cloth. The invention also concerns a process for making the nonwoven fabric.

2. Description of the Prior Art

Many types of woven and nonwoven materials have been suggested for use as dust-cloths. Superior dust-cloths should possess several important characteristics, such as the ability to absorb or lift dust from a surface without leaving lint or a residue on the wiped surface. The cloths should be soft to prevent scratching of the surface being cleaned. Further, the cloths should have sufficient stability to permit thorough rubbing of the surface without linting or destruction of the cloth. Removed dust should be retained by the dust-cloth and not drop off the cloth until the cloth is shaken. Some known dust-cloths are impregnated with an oily substance to assist in dust particle pickup and retention, but these often leave a residual film on the wiped surface.

A wide assortment of nonwoven materials have been disclosed for utilization in a large variety of uses. For example, Wideman, U.S. Pat. No. 4,606,964, discloses bulked composite materials for use in thermal garments, blankets, disposable swim wear, towels, wash cloths, training pants for infants, baby wipes, scouring pads, mattresses, cushions, sleeping bags and the like. Morman, U.S. Pat. No. 4,657,802, column 1, line 30, through column 4, line 32, reviews the disclosures of a large number of elastic nonwoven webs for use as, among other things, diaper components, bandages, filters, wearing apparel, etc. However, none of these disclosed materials involve the multi-needle stitching of a nonwoven fibrous layer with elastic thread.

Multi-needle stitching machines, such as "Arachne" or "Mali" machines (including Malimo, Malipol and Maliwatt machines) have been used to insert stitches into a wide variety of fibrous substrates. Such machines and some of the fabrics produced therewith are disclosed by K. W. Bahlo, "New Fabrics Without Weaving", Papers of the American Association for Textile Technology, Inc., pages 51–54 (November, 1965). Other disclosures of the use of such machines appear for example, in Ploch et al, U.S. Pat. No. 3,769,815, Hughes, U.S. Pat. No. 3,649,428 and Product Licensing Index, Research Disclosure, "Stitchbonded products of continuous filament nonwoven webs", page 30 (June 1968). However, none of these disclosures concern stitching of nonwoven sheets or batts with elastic thread.

An object of the present invention is to provide a nonwoven fabric which is a superior material for use as a dust-cloth.

SUMMARY OF THE INVENTION

The present invention provides a nonwoven fabric which comprises a layer of substantially nonbonded fibers of textile decitex, which layer is stitched through with an elastic thread that forms spaced apart rows of stitches extending along the length of the fabric, the fibrous layer being gathered between the stitches and rows of stitches of the elastic thread. Preferably, the gathered fibers provide the nonwoven fabric with a "bulk factor" (defined hereinafter) of at least 2.2, preferably at least 3.0 and most preferably in the range of 3.5 to 6. The stitching thread usually amounts to no more than 20% of the total weight of the nonwoven fabric, preferably 2 to 10%, and most preferably 3 to 5%. A preferred elastic stitching thread is a spandex elastomeric yarn, preferably having a dtex in the range of 20 to 200 and a break elongation in the range of 300 to 800%. Usually, the nonwoven fabric has a unit weight in the range of 80 to 250 grams per square meter, preferably 100 to 200 g/m$^2$. The row spacing usually is in the range of 2 to 10 rows per centimeter, preferably 3 to 6 per cm. The stitch spacing usually is in the range of 2 to 15 stitches per centimeter, preferably 4 to 12 per cm.

The present invention also provides a process for making the above-described nonwoven fabric, wherein a substantially nonbonded layer of fibers of textile decitex, weighing in the range of 15 to 75 g/m$^2$, is multi-needle stitched with an elastic thread that forms spaced-apart, parallel rows of stitches in the layer, the needle spacing being in the range of 2 to 8 needles per cm, and the stitches within each row being inserted at a spacing in the range the range of 1 to 7 stitches per centimeter, preferably 2 to 5 stitches per cm, the stitching thread being under sufficient tension to elongate the thread in the range of 100 to 250%, and then releasing the tension on the thread to cause contraction and gathering of the fabric area. In a preferred process, the fabric area after release of the tension is no greater than 40%, preferably in the range of 20 to 30% of the original area of the fibrous layer.

DETAILED DESCRIPTION OF PREFERRED EMBODIENTS

The invention will now be illustrated in detail with regard to a preferred nonwoven fabric made from a layer of substantially nonbonded, synthetic organic fibers, which layer is multi-needle stitched with a spandex elastomeric thread.

As used herein, the term "substantially nonbonded", with regard to the layer of natural or synthetic organic fibers of textile denier means that the fibers generally are not bonded to each other, as for example by chemical or thermal action. However, a small amount of point bonding or line bonding is intended to be included in the term "substantially nonbonded", as long as the bonding is not sufficient to prevent fibrous layer from contracting or gathering after stitching, as described hereinafter.

The term "fiber", as used herein, includes staple fibers and/or continuous filaments. The term "textile decitex" as used herein means fibers having a dtex in the range of 1 to 22.

The term "gathered" is used herein to describe the surface of the multi-needle elastic-yarn-stitched nonwoven fabric of the invention and to indicate that the area of the fabric of the invention is no more than 40% of area of the fibrous layer from which it was made, (i.e., before the layer was multi-needle stitched with the elastic thread).

Various methods can be employed for preparing the starting nonwoven layer of textile-dtex fibers suitable for use in the present invention. Natural fibers or fibers of synthetic organic polymer are preferred for the fibers of the starting layer. Batts of carded fibers, air-laid batts of filments or fibers, nonwoven sheets of continuous filaments, lightly bonded spunbonded sheets, sheets of hydraulically entangled fibers and the like are suitable.

Such fibrous layer batts or sheets are usually wound up in rolls. When heavier final products of the invention are desired, such batts or sheets can be positioned upon each other in preparation for the subsequent stitching step. Two or more can be used to make up the fibrous layer that will be stitched to form the fabric of the invention. However, a single batt or sheet of fibers is preferred for easier processing and lower cost operations.

In accordance with the process of the present invention, the stitching operation can be carried out with conventional muti-needle stitching equipment, for example of the Mali type mentioned hereinbefore. Malimo multi-needle stitching machines are particularly useful for making the nonwoven fabrics of the present invention. In the stitching step, spaced apart rows of stitches, generally extending along the length of the fabric, penetrate the nonbonded layer of organic fibers. This type of multi-needle stitching is sometimes referred to "stitch bonding".

Substantially any strong elastic thread is suitable as the stitching for use in the present invention. The elastic thread provides a force that causes the layer of substantially nonbonded fibers to contract or pucker. For example, conventional yarns that can elongate and retract include bare or covered spandex or rubber yarns. Equivalent results can sometimes be achieved with yarns that can be made to shrink after stitching, as for example, by treatment with steam, heat or chemicals.

A particularly preferred stitching thread is formed from spandex elastomeric yarn which has high elongation and retractive power. Such preferred yarns are available commercially (e.g., "Lycra" spandex yarn manufactured by E. I. du Pont de Nemours and Company). The spandex yarn can be inserted into the sheet under tension in a stretched condition, so that when the tension is released, the retractive forces of the yarns cause the sheet to contract or gather or pucker. Preferred yarns can elongate in the range of 300 to 800% and then retract from such elongation.

Usually the stitching thread amounts to no more than 20% of the weight of the fabric of the invention. However, the stitching thread preferably amounts to in the range of 2 to 10% and most preferably 2 to 5%.

In a preferred stitching step of the process, a series of interlocked loops is formed on one surface of the nonwoven fibrous starting layer and a parallel series of zig-zag tricot stitches on the other surface. Such rows of stitches are typical of those made by a "Mali" or an "Arachne" multi-needle stitching machine. Alternatively, the stitching can form rows of chain stitches along the length of the fabric. With regard to area contraction or gathering caused by retraction of the stitching, chain stitches cause almost all the gathering to take place in the longitudinal direction of the stitched layer whereas tricot stitches cause gathering across the width as well as the length of the fabric. The rows of stitches are inserted by needles which generally have a spacing in the range of 2 to 8 needles per cm and the stitches in each row are usually inserted at a spacing in the range of 1 to 7 stitches per cm, preferably 2 to 5 stitches per cm. Tricot stitching patterns are preferred.

As a result of stitching with the elastic thread under tension, when the tension is released and the fabric is relaxed (i.e., restraints are removed from the fabric), the fabric gathers and the area of the fabric becomes reduced. To determine the amount of gathering, measurements are made of the weight per unit area of (1) ($W_i$), the starting fibrous layer (2) ($W_f$), the stitched-and-relaxed fabric and (3) ($W_y$), the stitching yarn in the final relaxed fabric. The amount of gathering, or contraction or bulking that occurs, is referred to herein as the "Bulk Factor" and is calculated from these measurements by the following relationship:

$$\text{Bulk Factor} = BF = (W_f - W_y)/(W_i).$$

Generally, the more gathering that the fabric of the invention undergoes during fabrication (i.e., the larger the Bulk Factor) the better is the performance of the final fabric as a dust-cloth. The reciprocal of the Bulk Factor is the area of the final nonwoven fabric expressed as a fraction of the starting area of the fibrous layer.

The performance of a sample fabric as a dustcloth is rated by two types of dust pick-up and retention tests. In the first of these tests, a synthetic dust is spread on a smooth, polished surface of dark, smoky, scratch-resistant "Lucite" and then wiped by hand with the test cloth. The surface measures about 30 cm by 30 cm. The synthetic dust consists of about 75 parts by volume home-laundry-drier lint and 25 parts of automotive air-cleaner test dust (the latter, a product of AC Delco Division of General Motors Corporation). The synthetic dust is placed in a large "salt shaker" and sprinkled therefrom onto the surface in a thin layer. The surface of the Lucite is then wiped with a test cloth measuring about 15 cm by 15 cm. Five circular motions with light hand pressure are employed to wipe the surface. In the second type of dust-cloth test, the procedure of the first test is repeated, except that a drop of "Crisco" cooking oil (a product of Procter & Gamble Company) is spread on the Lucite surface just before spreading the synthetic dust on the surface.

The performance of the test cloth in the above-described tests is subjectively rated, 1 for excellent; 2 for very good, 3 for fair; and 4 for poor. For picking up dust, a rating of 1 indicates that substantially all the dust is removed from the surface; 2 indicates that more than half (but not all) of the dust is removed; 3 indicates that less than half the dust is removed; and 4 indicates that very little of the dust is removed (most of the dust is merely spread around the surface). For retaining dust in the cloth when the sample is gently shaken after dust-pickup testing, a rating of 1 indicates that substantially all the dust is retained in the sample; 2 indicates that at least about half (but not all) of the picked-up dust is retained; 3 indicates that more than half of the picked-up dust is not retained; and 4 indicates that almost all of the picked-up dust is not retained by the cloth. Results of the rating tests show that whether or not oil is spread on the surface before the dust is sprinkled thereon, the rating and ranking of the test cloths are substantially the same.

Other characteristics herein are measured by the following procedures. Unit weight of the starting fibrous layer and of the final multi-needle stitched fabric are measured in accordance with ASTM D 3776-79. Thickness is measured with a conventional thickness gauge having a 1-cm-diameter cylindrical foot loaded with a 100 gram-weight. The weight of stitching thread per unit area of fabric is determined by removing and weighing the amount of stitching thread in a given area of fabric. Elongation of spandex yarns are measured in accordance with general procedures of ASTM D 2731-72.

EXAMPLES

These examples illustrate the fabrication of six non-Woven fabrics of the invention (designated samples 1 through 6). The Examples also demonstrate the dust-cloth-perfomance advantages of these fabrics over comparison fabrics (designated A and B) that are similarly fabricated but are outside the scope of the invention. The dust-cloth performance of the nonwoven fabrics of the invention are also compared to six commercial wipe cloths (designated C through H).

The starting fibrous layer for each of samples 1–6 and comparison sample A was a roll of nonwoven web of substantially nonbonded, organic fibers of textile dtex. Each roll was fed in the machine direction of a Malimo multi-needle stitching machine. Bare spandex yarn ("LYCRA" type-126, available commercially from E. I. du Pont de Nemours and Company) was used to multi-needle tricot stitch each fabric. A stitch length of 2 mm (i.e., 5 per cm) and a 12-gauge needle bar (i.e., 12 needles per 25 mm) were employed. Sufficient tension was placed on the yarn to provide a thread elongation of at least 200%. The machine was operated to form about 750 courses per minute which corresponded to stitching a length about 1.5 meters of fibrous layer per minute. The stitching of the elastomeric thread was adjusted to provide about a 4% stitching thread content and various Bulk Factors to the test fabrics.

The starting nonwoven fibrous layers for samples 1–6 and for comparison samples A and B are described in the following list. In the last portion of the list, comparison commercial samples C–H are described.

1. "Reemay", a substantially nonbonded sheet of continuous polyester filaments of 2.0 dtex, sold by Reemay Inc. of Old Hickory, Tenn.
2. Same as 1.
3. Same as 1, except filament dtex is 4.4.
4. "Polybond", a point-bonded sheet of continuous polypropylene filaments of 1.7 dtex, sold by Polybond of Waynesboro, Va.

A. Same as 4.

5. "Sontara", Style 8010, a hydraulically entangled web of polyester staple fibers of 1.5 dtex, sold by E. I. du Pont de Nemours and Company of Wilmington, Del.

B. Same as 5, but not multi-needle stitched.

6. Hydraulically entangled web of acrylic staple fibers of 1.7 dtex.

Commercial Cloths

C. Embossed paper towel sold by Kimberly-Clark
D. "Baby-cloth", cotton terry-cloth sold by Gerber.
E. "Supercloth", nonwoven fabric sold by Cadie
F. "Stretch & Dust", nonwoven cloth sold by Chicopee.
G. "Supercloth", same as E, but of lighter weight.
H. "Black Wonder", woven gauze sold by Ritz.

Additional characteristics and results of dust-cloth-performance tests for the above-identified test samples are summarized in Tables I and II.

TABLE I

| Fabrics of Samples 1–6 and Comparisons A–B | | | | | | | |
|---|---|---|---|---|---|---|---|
| | | Weight** g/m² | | Thick- | | Rating | |
| Test Sample | Yarn* dtex | $W_i$ | $W_f$ | ness mm | Bulk Factor | Dust Pickup | Dust Retain |
| 1 | 155 | 51 | 183 | 1.30 | 3.5 | 1 | 1 |
| 2 | 155 | 31 | 95 | 1.14 | 3.0 | 2 | 1 |
| 3 | 155 | 58 | 147 | 1.68 | 2.4 | 2 | 2 |
| 4 | 22 | 34 | 137 | 1.27 | 3.8 | 1 | 2 |
| A | 22 | 51 | 75 | 0.89 | 1.4 | 3 | 3 |
| 5 | 155 | 44 | 253 | 1.91 | 5.5 | 1 | 1 |
| B | — | 32 | 32 | 0.46 | 1.0 | 3 | 3 |
| 6 | 155 | 41 | 148 | 1.40 | 3.6 | 1 | 1 |

Notes:
*dtex of relaxed stitching yarn (i.e., in the not-stretched condition).
**$W_i$ is the initial weight of the fibrous layer before stitching; $W_f$ is the total weight of the stitched fabric (including the elastic stitching).

TABLE II

| Commercial Samples | | | | |
|---|---|---|---|---|
| | | Thick- | Rating | |
| Test Sample | Weight g/m² | ness mm | Dust Pickup | Dust Retain |
| C | 92 | 0.58 | 4 | 4 |
| D | 405 | 0.99 | 4 | 4 |
| E | 239 | 0.38 | 4 | 4 |
| F | 60 | 0.66 | 4 | 4 |
| G | 143 | 1.57 | 3 | 2 |
| H | 39 | 0.25 | 3 | 3 |

As shown by Tables I and II, the fabrics of the invention, samples 1–6, were rated "excellent" to "very good" in picking up dust and retaining picked-up dust. Each test sample of the invention readily removed and retained the dust. In contrast, comparison samples A and B and commercial cloths C through H rated considerably lower than each test sample of the invention. Two of the six commercial samples were rated "fair" in the dust pick-up test; the other four, were rated "poor". In the dust-retain test, only one of the commercial samples was rated as "very good"; one was rated "fair"; and the remaining four were rated "poor".

Generally, the larger Bulk Factor in the stitched nonwoven fabrics of the invention, resulted in better performance in the dust-cloth tests. This is shown in Table I by comparison of test samples 1, 2 and 3. Note also that comparison samples A and B, which respectively had Bulk Factors of 1.4 and 1.0, rated only "fair" in the dust-cloth tests, in comparison to the "exellent"-to-"very good" ratings for the samples of the invention, which had Bulk Factors in the range of 2.4 to 5.5.

In the preceding Examples, nonwoven fabrics of the invention were shown to be particularly suited for use as dust-cloths. When the fabric of the invention is fashioned into a simple mitten, another especially useful form of dust-cloth results. Also, the fibrous layer of the nonwoven fabric of the invention can be treated with various agents for special purposes. For example, treatment with soap that is activated or released when wetted with water, makes the nonwoven fabric very useful as a wash cloth. The fabric also has utility in other applications. For example, because of its structure, the nonwoven fabric has a high insulating valve and therefore is suited for use in thin insulative gloves, in thermal underwear, blankets and the like.

What is claimed is:

1. A nonwoven fabric which comprises a layer of substantially nonbonded fibers of textile decitex, the layer being stitched through with elastic thread that forms spaced-apart rows of stitches extending along the length of the fabric, the fibrous layer being gathered between the stitches and rows of stitches, and the elastic thread amounting to no more than 20% of the total weight of the nonwoven fabric.

2. A nonwoven fabric of claim 1 wherein the elastic yarn is a spandex elastomeric yarn.

3. A nonwoven fabric of claim 2 wherein the spandex yarn has a dtex in the range of 20 to 200 and a break elongation in the range of 300 to 800%.

4. A nonwoven fabric of claim 1 or 2 wherein the amount of elastic yarn is in the range of 2 to 10%.

5. A nonwoven fabric of claim 1 or 2 wherein the amount of elastic yarn is in the range of 3 to 5%.

6. A nonwoven fabric of claim 2 wherein the fabric has a bulk factor of at least 2.2.

7. A nonwoven fabric of claim 6 wherein the bulk factor is at least 3.0.

8. A nonwoven fabric of claim 6 wherein the bulk factor is in the range of 3.5 to 6.

9. A nonwoven fabric of claim 1, 2 or 6 wherein the row spacing is in the range of 2 to 10 rows per cm, the stitch spacing is in the range of 2 to 15 stitches per cm and the unit weight of the fabric is in the range of 80 to 250 grams per square meter.

10. A nonwoven fabric of claim 1, 2 or 6 wherein the row spacing is in the range of 3 to 6 rows per cm, the stitch spacing is in the range of 4 to 12 stitches per cm and the unit weight of the fabric is in the range of 100 to 200 grams per square meter.

11. A nonwoven fabric of claim 1, 2 or 6 wherein the stitches are tricot stitches.

12. A process for making a nonwoven fabric, particularly suited for use as a dust-cloth, wherein a substantially nonbonded layer of fibers of textile dtex, weighing in the range of 15 to 75 g/m$^2$, is multi-needle stitched with an elastic thread that forms spaced-apart rows of stitches in the layer, the needle spacing being in the range of 2 to 8 needles per cm, and the stitches within each row being inserted at a spacing in the range of 1 to 7 stitches per centimeter, the stitching thread being under sufficient tension to elongate the thread in the range of 100 to 250%, and then releasing the tension on the thread to cause contraction and gathering of the fabric area.

13. A process of claim 12 wherein the stitch spacing is in the range of 2 to 5 stitches per centimeter.

14. A process of claim 12 wherein release of the tension in the thread causes the nonwoven fabric to contract to a finished area that is no greater than 40% of the original area of the layer of fibers.

15. A process of claim 14 wherein the nonwoven fabric contracts to an area in the range of 20 to 30% of the original area of the layer of fibers.

16. A process of claim 12, 13, 14 or 15 wherein the elastic stitching thread is a spandex elastomeric yarn.

* * * * *